US009837741B2

(12) United States Patent
Sachs et al.

(10) Patent No.: US 9,837,741 B2
(45) Date of Patent: Dec. 5, 2017

(54) ELECTRICAL CONTACT ELEMENT WITH A FINELY STRUCTURED CONTACT SURFACE

(71) Applicant: TE Connectivity Germany GmbH, Bensheim (DE)

(72) Inventors: Soenke Sachs, Frankfurt am Main (DE); Volker Seipel, Bensheim (DE); Helge Schmidt, Speyer (DE); Viktor Holzmann, Mainz-Ebersheim (DE); Felix Greiner, Griesheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/164,986

(22) Filed: May 26, 2016

(65) Prior Publication Data

US 2016/0352033 A1 Dec. 1, 2016

(30) Foreign Application Priority Data

May 28, 2015 (DE) ..... 10 2015 209 855

(51) Int. Cl.

| | |
|---|---|
| ***H01R 9/24*** | (2006.01) |
| ***H01R 13/02*** | (2006.01) |
| ***H01R 13/03*** | (2006.01) |
| ***H01R 4/18*** | (2006.01) |
| *H01R 4/58* | (2006.01) |

(52) U.S. Cl.
CPC ..... *H01R 13/03* (2013.01); *H01R 4/188* (2013.01); *H01R 4/58* (2013.01)

(58) Field of Classification Search
CPC ..... H01R 4/185; H01R 4/188; H01R 13/03; H01R 43/16; H01R 4/20
USPC ..... 439/877, 886
See application file for complete search history.

(56) References Cited

U.S. PATENT DOCUMENTS

| | | | | |
|---|---|---|---|---|
| 2,735,997 A * | 2/1956 | Peterson | H01R 4/203 248/902 |
| 3,892,459 A * | 7/1975 | Dittmann | H01R 4/188 174/84 C |
| 4,979,793 A | 12/1990 | Bowen et al. | |
| 5,757,997 A | 5/1998 | Birrell et al. | |
| 7,210,958 B1 * | 5/2007 | Jacques | H01R 4/185 439/421 |

(Continued)

FOREIGN PATENT DOCUMENTS

| | | |
|---|---|---|
| DE | 19951257 A1 | 4/2001 |
| DE | 102012220820 A1 | 5/2014 |

(Continued)

OTHER PUBLICATIONS

German Office Action, dated Apr. 2, 2015, 5 pages.

(Continued)

*Primary Examiner* — Hae Moon Hyeon
(74) *Attorney, Agent, or Firm* — Barley Snyder

(57) ABSTRACT

An electrical contact element is disclosed. The electrical contact element includes a contact surface of an electrically conductive contact body having a plurality of coated regions with a first coating and a plurality of uncoated regions without the first coating, the coated regions and uncoated regions arranged in an alternating manner in a variation direction along the contact surface.

17 Claims, 4 Drawing Sheets

(56) References Cited

U.S. PATENT DOCUMENTS

| | | | | |
|---|---|---|---|---|
| 8,177,591 | B2 * | 5/2012 | Okamura | H01R 4/188 439/877 |
| 8,303,355 | B2 * | 11/2012 | Ono | H01R 4/185 439/877 |
| 8,337,262 | B2 * | 12/2012 | Ono | H01R 4/185 439/877 |
| 8,485,853 | B2 * | 7/2013 | Seifert | H01R 4/188 439/882 |
| 8,641,461 | B2 * | 2/2014 | Mitose | H01R 4/185 439/587 |
| 8,974,258 | B2 * | 3/2015 | Mitose | H01R 4/184 439/877 |
| 9,391,384 | B2 * | 7/2016 | Kodama | H01R 4/62 |
| 9,455,504 | B2 * | 9/2016 | Kim | H01R 4/28 |
| 2003/0123838 | A1 | 7/2003 | Wang et al. | |
| 2011/0232083 | A1 | 9/2011 | Daitou et al. | |
| 2012/0028494 | A1 | 2/2012 | Ono et al. | |
| 2015/0188244 | A1 * | 7/2015 | Yoshioka | H01M 2/20 439/442 |
| 2015/0357722 | A1 * | 12/2015 | Sato | H01R 13/5216 439/877 |
| 2016/0006167 | A1 | 1/2016 | Morikawa | |

FOREIGN PATENT DOCUMENTS

| | | | |
|---|---|---|---|
| EP | 0544521 | A2 | 11/1992 |
| EP | 1514634 | A1 | 3/2005 |
| EP | 2555328 | A1 | 2/2013 |
| EP | 2765652 | A1 | 8/2014 |
| JP | 2002139651 | A | 5/2002 |
| JP | 2014164926 | A | 9/2014 |
| JP | 2014164937 | A | 9/2014 |
| WO | 2014075794 | A1 | 5/2014 |

OTHER PUBLICATIONS

German Office Action, dated Dec. 14, 2015, 6 pages.

English translation of JP2014-164926A, dated Sep. 8, 2014, 10 pages.

English translation of JP2014-164937A, dated Sep. 8, 2014, 10 pages.

European Search Report, dated Oct. 25, 2016, 11 pages.

* cited by examiner

ELECTRICAL CONTACT ELEMENT WITH A FINELY STRUCTURED CONTACT SURFACE

CROSS-REFERENCE TO RELATED APPLICATIONS

This application claims the benefit of the filing date under 35 U.S.C. §119(a)-(d) of German Patent Application No. 102015209855.9, filed May 28, 2015.

FIELD OF THE INVENTION

The invention relates to an electrical contact element, and more particularly, to a contact surface of an electrical contact element.

BACKGROUND

Electrical contacts formed of conductive materials and used to establish a direct electrical connection to another conductive element are known in the art. Known electrical contacts, for example, are used in the contact section of a plug contact, cable shoe, ferrule, crimp section, or other known forms of electrical connectors to connect to a known conductive element such as a cable, wire, bundle of strands, plug element, or bushing.

The characteristics of the contact surface of the electrical contact are particularly important to the reliability of the electrical connection to the other conductive element. Particularly good electrical conductivity is required at the contact surface. Furthermore, since the contact surface is additionally frequently used to enter into a frictionally engaged, force-fitting, and/or materially engaged connection to the other conductive element, the mechanical characteristics of the contact surface are also important to the electrical connection.

SUMMARY

An object of the invention, among others, is to provide an electrical contact element with improved electrical conductivity and improved mechanical characteristics. The contact element of the invention is also able to be manufactured in large quantities in a cost-efficient manner. The disclosed electrical contact element includes a contact surface of an electrically conductive contact body having a plurality of coated regions with a first coating and a plurality of uncoated regions without the first coating, the coated regions and uncoated regions arranged in an alternating manner in a variation direction along the contact surface.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an electrical contact element. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
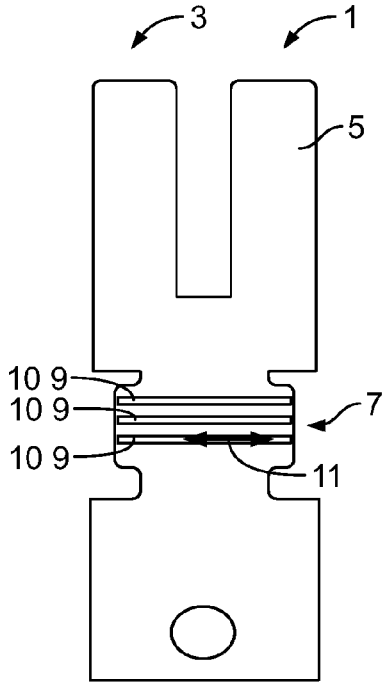
FIG. 1 is a top view of a contact element according to the invention.

A contact element 3 according to the invention is shown generally in FIG. 1. In the shown exemplary embodiment, the contact element 3 is a stamped bending part 1. One with ordinary skill in the art, however, would understand that the solution according to the invention can be employed for a wide range of contact elements 3, including those forming a crimp connection, plug contact, cable shoe, ferrule, or other electrical connectors known in the art.

The contact element 3 includes a contact body 5 and a contact surface 7. Contact body 5 is formed of an electrically conductive material, and may be a sheet metal.

Contact surface 7 can have any suitable form. In the shown embodiment, contact surface 7 forms a bending crimp section, but could also form a crimp clip, crimp wing, or other known electrical contact section. Contact surface 7 includes at least one recess 10, at least one coated region 13, and at least one uncoated region 17.

Figure 2:
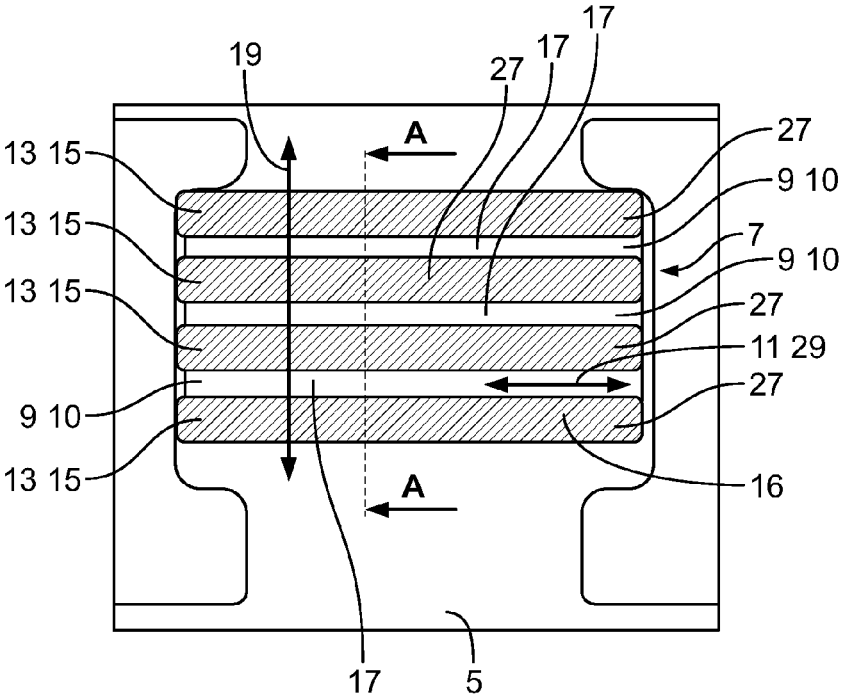
FIG. 2 is an enlarged view of a contact surface of the contact element shown in FIG. 1.
Figure 3A:
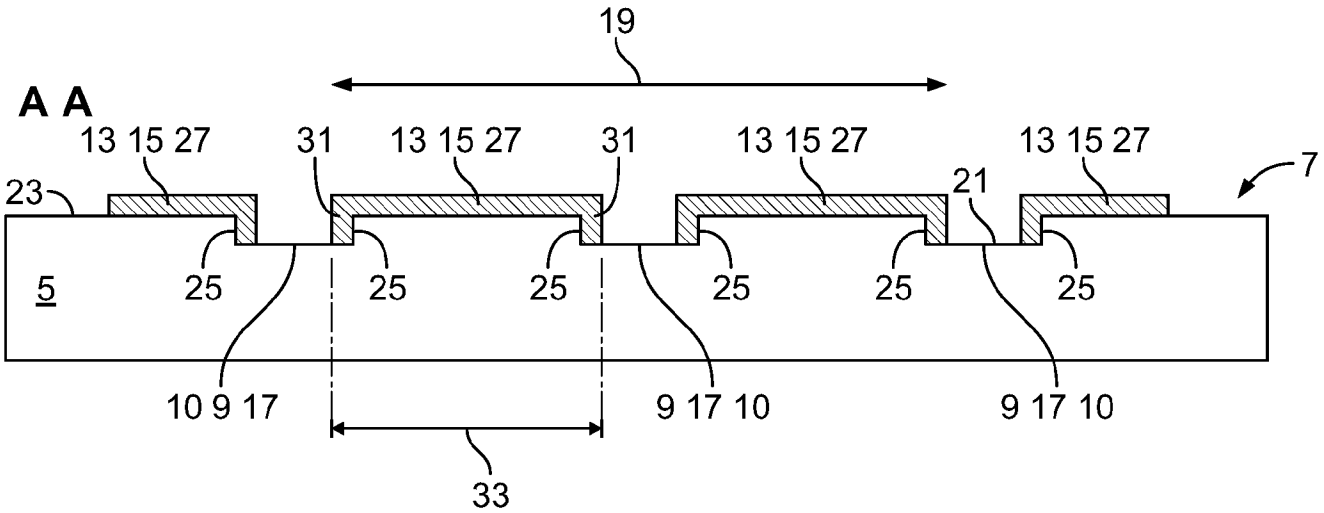
FIG. 3A is sectional view taken along line A-A of the contact surface of FIG. 2.

The at least one recess 10, as shown in FIG. 2, may be configured as an elongated furrow 9. The furrow 9 may be impressed, stamped, chased or deep-drawn into contact body 5. A longitudinal direction 11 of the furrow 9 runs perpendicular to a longitudinal direction of the contact element 3. Three furrows 9 are shown in the embodiment of FIGS. 1-7, but one with ordinary skill in the art would understand that the number of furrows 9 could vary. As shown in FIG. 3A, furrows 9 form surface offsets 25 between, in each case, a base surface 21 of the furrow 9 and a top surface 23 of the contact surface 7. Surface offsets 25 represent flanks or shoulders of the furrows 9 in cross-section.

In other embodiments, contact surface 7 can have recesses 10 formed differently than the shown furrows 9. Instead of a furrow 9, the recess 10 can also have the form of a groove or a corrugation. Alternatively, the recess 10 can also have a large-area rectangular form. Furthermore, the furrows 9 may not be continuous. Likewise, alternatively or additionally, contact surface 7 can have elevations instead of recesses.

The at least one coated region 13, shown in FIGS. 2 and 3A, has a first coating 15. The first coating 15 can be selected, for example, such that it has increased electrical conductivity compared to the contact body 5. The first coating 15 may also be harder than the contact body 5. The first coating 15 may be formed from tin, zinc, silver, bismuth, or other materials known to those with ordinary skill in the art.

First coating 15 is directly deposited on contact body 5 without any intervening layers. The coated regions 13 may be formed by methods in which the first coating 15 is selectively directly deposited on the contact surface 7 and then hardened, surface-fused and/or sintered using energy-rich radiation. The first coating 15 can alternatively be deposited in the desired form and dimensions onto the contact surface 7, for example, by printing methods. The first coating 15 can be fixed and connected to the contact surface 7 by the energy-rich radiation which may be electron radiation, ion radiation or laser radiation.

Each coated region 13 has a surface 16. As shown in FIG. 2, each coated region 13 may be formed as a stripe 27, with a longitudinal direction of the stripe 27 running parallel to the longitudinal direction 11 of the furrows 9. Each stripe 27 has edge regions 31 and a width 33. In the shown embodiment, the stripe width 33 measured perpendicular to the longitudinal direction of the stripe is less than 500 μm, and is another embodiment, is less than 300 μm.

The at least one uncoated region 17 is located between coated regions 13 with first coating 15. The uncoated regions 17 have no coating. The coated regions 13 with first coating 15 and the uncoated regions 17 without first coating 15, as shown in the embodiment of FIG. 2, alternate along the first direction of variation 19. First direction of variation 19 may run perpendicular to longitudinal direction 11 of furrows 9. The uncoated regions 17 without first coating 15 can be situated inside furrows 9.

As shown in FIG. 3A, the stripes 27 are arranged on the top surface 23 of contact surface 7 between uncoated regions 17, and extend toward base surface 21 of furrows 9; as a result, surface offsets 25 of furrows 9 are covered with first coating 15. Edge regions 31 of each stripe 27 extend in two adjacent furrows 9.

The contact element 3 is used to form an electrical connection with a conductive element (not shown). The contact surface 7 contacts the conductive element to form the electrical connection. If the contact surface 7 according to the invention is pressed against the conductive element, for example by contact surface 7 being arranged in a crimp region which is squeezed onto the conductive element, surface offsets 25 exert a particularly large force onto the conductive element and partially penetrate into the conductive element. Particularly good electrical conductivity and mechanical hardness in the region of surface offsets 25 is of great significance for a good connection between contact surface 7 and the conductive element. Since the surface offsets 25 are covered by coated regions 13 with first coating 15, a reliable connection between the contact surface 7 and the conductive element is formed.

Figure 3B:
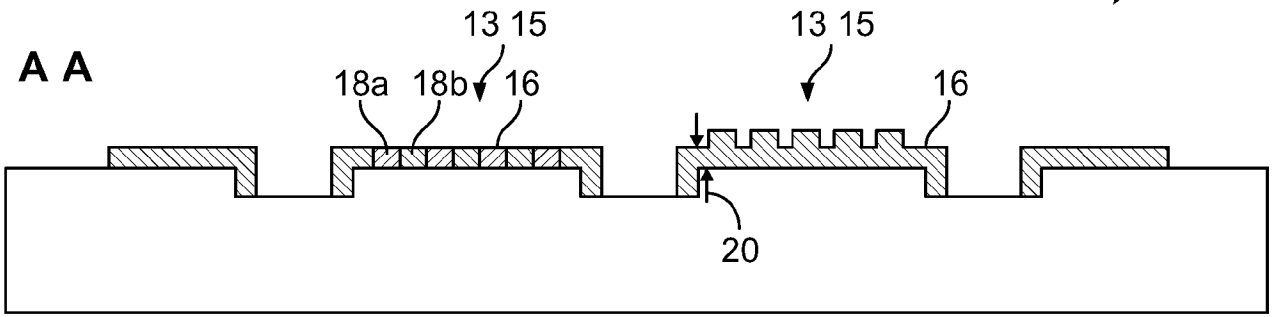
FIG. 3B is a sectional view of other embodiments of coated regions of the contact surface shown in FIG. 3A.

FIG. 3B shows two additional embodiments of the coated region 13 configuration. The configurations shown are merely exemplary, and the two configurations do not necessarily have to be arranged on the same contact element 3.

The left side of FIG. 3B shows a coated region 13 with a smooth surface 16. In this embodiment, first coating 15 is divided into two different phases 18*a* and 18*b*. In the different phases, the material of first coating 15 can have different characteristics. For example, the composition of the material can be different in the two phases, even if they have been generated from the same starting material of first coating 15. The phases 18*a* and 18*b* can be generated through the selection of a suitable material for first coating 15 and/or a suitable after-treatment, for example, via the energy-rich radiation. Alternatively or in addition, two different materials, for example first coating 15 and a second coating 41, can be used instead of two different phases 18*a* and 18*b*.

The right side of FIG. 3B shows a coated region 13 with first coating 15, wherein the surface 16 of the first coating 15 is structured. Surface 16 is structured such that a thickness 20 of first coating 15 varies in cross-section. Surface 16 can have burls, ribs or teeth, for example, such that a structure is formed with varying thickness 20.

Figure 4:
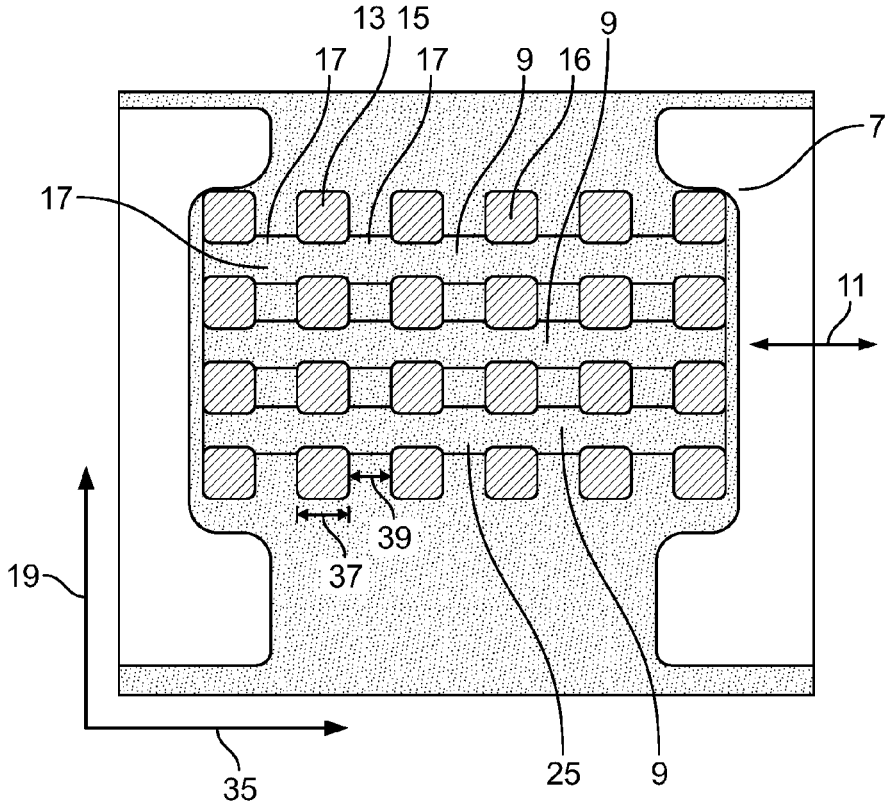
FIG. 4 is a top view of a second embodiment of a contact surface.

FIG. 4 shows a second embodiment of a contact surface 7 according to the invention. For the sake of brevity, only the differences from the contact surface 7 described with reference to FIGS. 2 and 3 are explored hereafter.

The second embodiment of contact surface 7 according to the invention has a second direction of variation 35 which runs parallel to longitudinal direction 11 of furrows 9. The coated regions 13 therefore also alternate with uncoated regions 17 in the direction of variation 35. Through the alternating arrangement of coated regions 13 and uncoated regions 17 along two directions of variation 19 and 35 which are perpendicular to one another, an at least partial coating can be achieved with a very low amount of coating material 15. In order to obtain as uniform a distribution of regions 13 and 17 over contact surface 7 as possible, coated regions 13 have, at least in direction of variation 35, a length 37, which substantially corresponds to the length 39 of a uncoated region 17 in direction of variation 35. Length 39 of uncoated region 17 is the distance between two adjacent regions 13 in direction of variation 35.

Through the described arrangement of coated regions 13 of the second embodiment, direction of variation 39 follows the course of surface offsets 25, which run parallel to longitudinal direction 11 of furrows 9. Two coated regions 13 respectively are situated opposite one another over a furrow 9. Therefore, coated regions 13 are each situated at the same height along longitudinal direction 11 of furrows 9.

Figure 5:
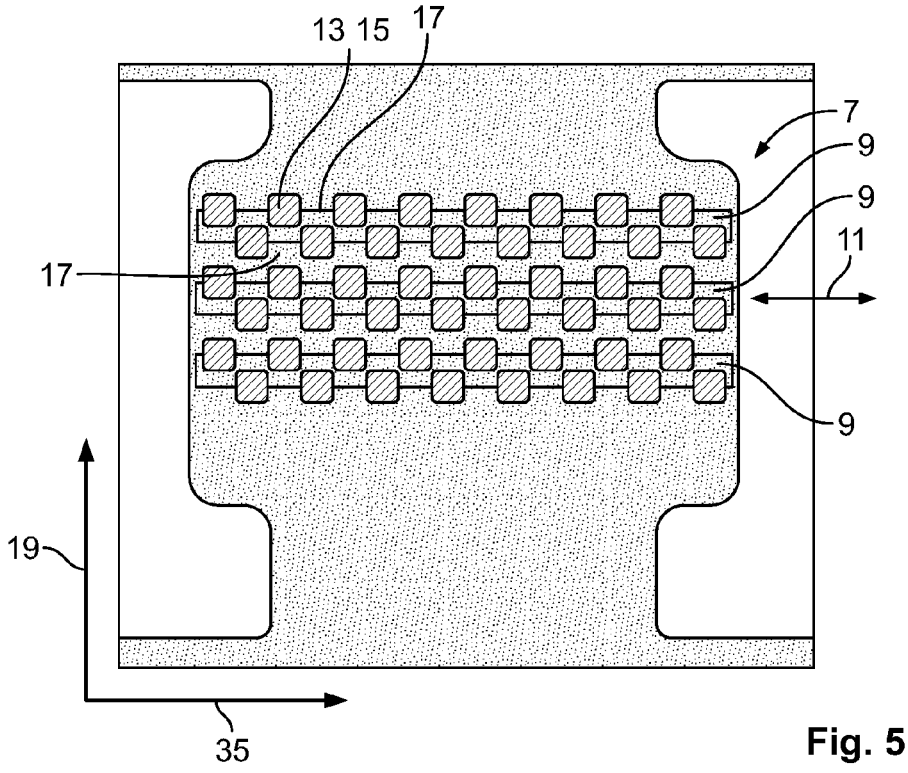
FIG. 5 is a top view of a third embodiment of a contact surface.

FIG. 5 shows a third embodiment of a contact surface 7 according to the invention. Here too, for the sake of brevity, only the differences from the preceding embodiments are described. Coated regions 13 alternate with uncoated regions 17 in two directions of variation 19 and 35, which are perpendicular to one another. In contrast to the second embodiment, coated regions 13 are, however, staggered relative to one another in longitudinal direction 11 of furrows 9. As a result, in longitudinal direction 11 of furrows 9, a coated region 13 is arranged in each case at a surface offset 25 of a furrow 9 between two opposing coated regions 13. The coated regions 13 can extend into a middle of base surface 21 of furrows 9. Through the arrangement of regions 13 and 17 of the third embodiment, a substantial covering of contact surface 7 with coated regions 13 can be achieved with a low quantity of coating material.

Figure 6:
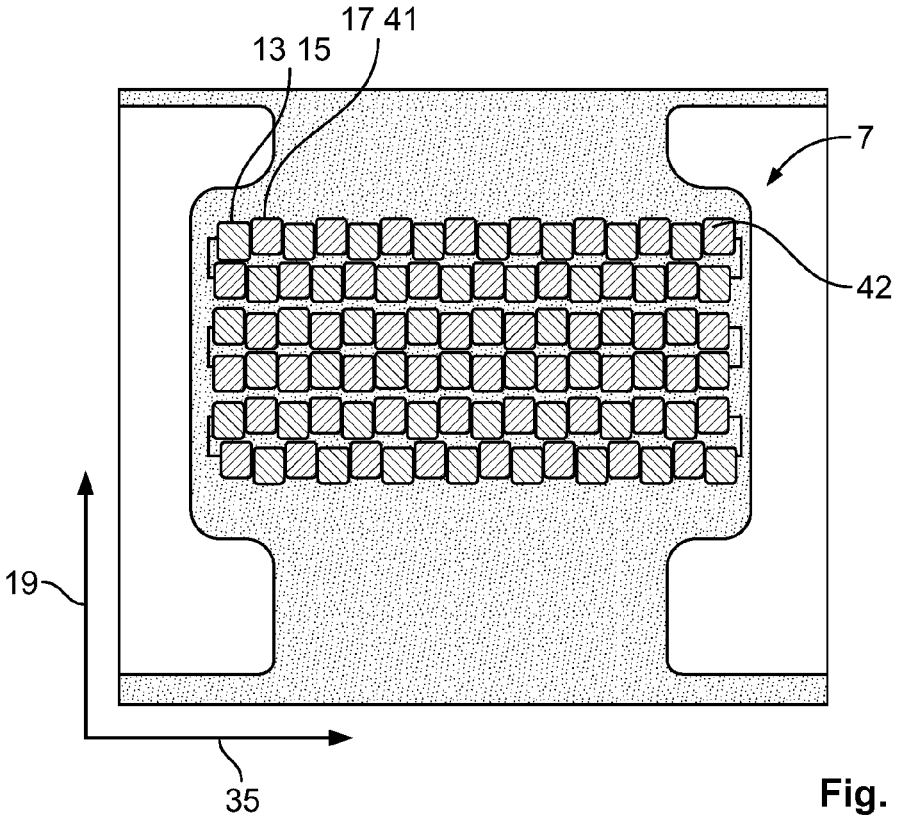
FIG. 6 is a top view of a fourth embodiment of a contact surface.

FIG. 6 shows a fourth embodiment of a contact surface 7 according to the invention. Contact surface 7 has coated regions 13 which correspond to those of the embodiment described with reference to FIG. 5. Uncoated regions 17, at least those which are located between coated regions 13 in direction of variation 35, can have a second coating 41. Second coating 41 can consist of a material other than first coating 15. Alternatively or in addition, second coating 41 can also consist of the same material as coating 15, but, through a suitable treatment, can have a structure which is different from first coating 15. For example, at least one of coatings 15 or 41 can have a surface 16 or 42 which is structured such that two different surface structures are formed.

Figure 7:
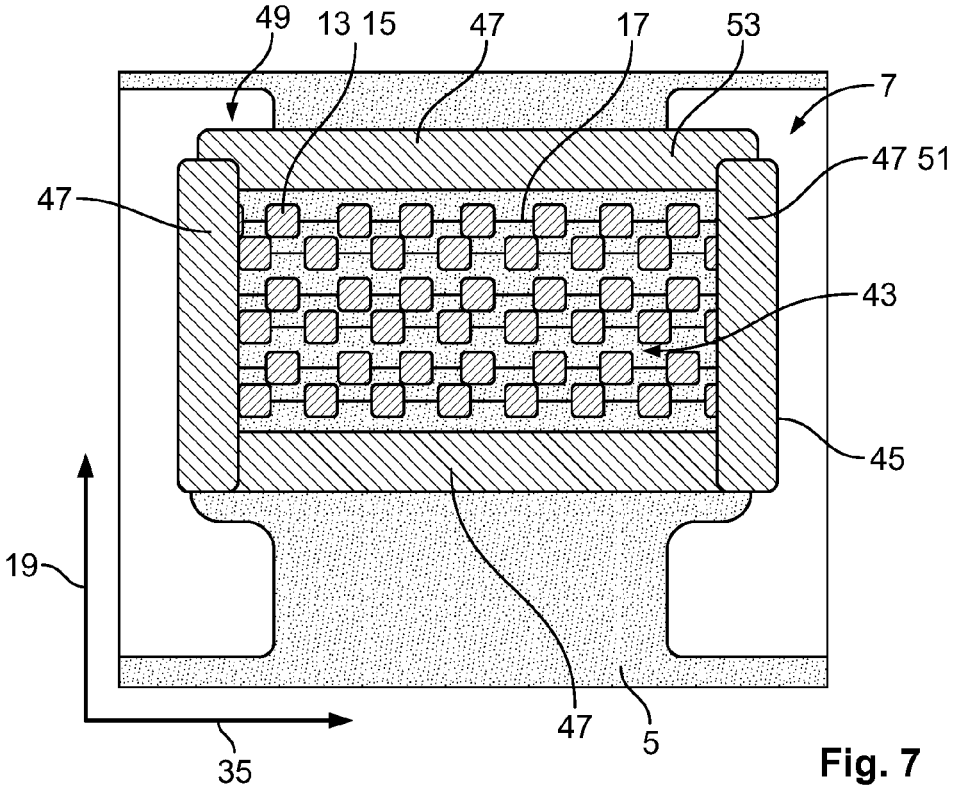
FIG. 7 is a top view of a fifth embodiment of a contact surface.

FIG. 7 shows a fifth embodiment of a contact surface 7 according to the invention. In this embodiment, purely by way of example, coated regions 13 and uncoated regions 17 in inner region 43 are depicted identically to those of the third embodiment described with reference to FIG. 5. Inner region 43, however, can be formed in accordance with each of the embodiments described previously. Inner region 43 can also be formed in accordance with all other contact surfaces 7 according to the invention.

In contrast to the embodiments described above, the fifth embodiment of contact surface 7 according to the invention has boundary regions 47 with a third coating 45. In this case, boundary regions 47 are arranged in an edge region 49 of contact surface 7. The boundary regions 47 are formed in the form of stripes and follow edge region 49 of contact surface 7. Individual boundary regions 47 touch or cover one another, such that a continuous boundary region 47 is formed which fully surrounds inner region 43 of contact surface 7.

Third coating 45 is softer than first coating 15 and, if it is present, second coating 41. Third coating 45 can serve to seal contact surface 7, in particular if contact surface 7 is part of a crimp section which is pressed together or against another element. Third coating 45 is formed by a metal which is more base than the material of first coating 15, second coating 41 and contact body 5. As a result, third coating 45 can serve as a sacrificial anode 51 for contact element 3. A surface 53 of third coating 45 can be structured similarly to surface 16 of the first coating and surface 42 of the second coating.

According to a further advantageous configuration of the invention, at least one coated region 13 or a combination of coated regions 13 can be formed at least in sections as a data-carrying structure. The data-carrying structure can, for example, have data regarding the type or the characteristics of the contact element 13. Data such as the name or contact information regarding the manufacturer or its logo can be formed in the at least one coated region 13. The data-carrying structure may be formed as a two-dimensional code, for example as a barcode. A two-dimensional code can vary greatly over a large surface, permitting the first coating 15 to still cover a substantial area. It is likewise possible that the data-carrying structure is formed as a one-dimensional bar code, for example as digits or as letters.

Advantageously, according to the invention, the first coating 15 disposed over the surface offsets 25 provides a more reliable electrical connection to another conductive element. Furthermore, by having uncoated regions 17 located between coated regions 15, coating material and corresponding manufacturing cost can be saved in comparison to a complete coating of the contact surface while maintaining uniform coverage of the contact surface. The alternating arrangement of coated regions 13 and uncoated regions 17 also improves the mechanical stability of the contact element 3 in the region of the contact surface 7, because twisting, as can arise in the case of large area coating, can be avoided. Furthermore, since one stripe 27 can cover two adjacent surface offsets 25 of two adjacent furrows 9, manufacturing is easier.

What is claimed is:

1. An electrical contact element, comprising:

a contact surface of an electrically conductive contact body having a plurality of conductive coated regions with a first type of coating and a plurality of uncoated regions without the first type of coating, the coated regions and uncoated regions arranged in an alternating manner in a variation direction along the contact surface.

2. The electrical contact element of claim 1, wherein each coated region has a dimension of less than 500 μm.

3. The electrical contact element of claim 1, wherein the contact surface has a recess with a surface offset positioned between the recess and the contact surface.

4. The electrical contact element of claim 3, wherein one coated region covers a portion of the surface offset.

5. The electrical contact element of claim 4, wherein each coated region is stripe-shaped and extends parallel to a longitudinal direction of the recess.

6. The electrical contact element of claim 5, wherein the contact surface has a plurality of recesses.

7. The electrical contact element of claim 6, wherein one stripe-shaped coated region covers a portion of each of two adjacent surface offsets of two adjacent recesses.

8. The electrical contact element of claim 4, wherein the coated regions and uncoated regions are arranged in an alternating manner along a direction of the surface offset.

9. The electrical contact element of claim 8, wherein one recess has a first surface offset and a second surface offset extending in parallel, and the coated regions of the first surface offset are positioned opposite the coated regions of the second surface offset.

10. The electrical contact element of claim 8, wherein one recess has a first surface offset and a second surface offset extending in parallel, and the coated regions of the first surface offset are staggered with respect to the coated regions of the second surface offset.

11. The electrical contact element of claim 1, wherein the coated regions and uncoated regions have the same length in the variation direction.

12. The electrical contact element of claim 1, wherein the contact surface has a boundary region positioned along edges of the contact surface and an inner region positioned within the boundary region.

13. The electrical contact element of claim 12, wherein the boundary region has a third type of coating.

14. The electrical contact element of claim 13, wherein the inner region has coated regions and uncoated regions.

15. The electrical contact element of claim 14, wherein the third type of coating is a sacrificial anode for the contact body and first type of coating.

16. The electrical contact element of claim 1, wherein at least one coated region has a structured surface.

17. The electrical contact element of claim 1, wherein a structure forming data regarding the contact element is formed in at least a portion of one coated region.

* * * * *